US007287821B2

(12) United States Patent
Uraki et al.

(10) Patent No.: US 7,287,821 B2
(45) Date of Patent: Oct. 30, 2007

(54) LIQUID JETTING DEVICE AND DRIVE VOLTAGE CORRECTION METHOD

(75) Inventors: Shingo Uraki, Tokyo (JP); Akiko Kitami, Tokyo (JP); Katsuaki Komatsu, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 262 days.

(21) Appl. No.: 11/201,438

(22) Filed: Aug. 10, 2005

(65) Prior Publication Data

US 2006/0033768 A1 Feb. 16, 2006

(30) Foreign Application Priority Data

Aug. 12, 2004 (JP) ..... 2004-235451

(51) Int. Cl.
*B41J 29/38* (2006.01)

(52) U.S. Cl. ..... 347/14; 347/19; 347/57

(58) Field of Classification Search ..... 347/14, 347/10, 19

See application file for complete search history.

(56) References Cited

U.S. PATENT DOCUMENTS 5,633,671 A * 5/1997 Watanabe ..... 347/192

* cited by examiner

*Primary Examiner*—Thinh Nguyen
(74) *Attorney, Agent, or Firm*—Cohen Pontani Lieberman & Pavane LLP

(57) ABSTRACT

A liquid jetting device having: a recording head including a jetting energy generating element; a drive circuit generating drive signal for the element; a liquid detection sensor detecting a jetting characteristic value of liquid jetted from a nozzle; a drive voltage adjustment unit adjusting a voltage value of the drive signal; and a controller to control the drive circuit, the sensor and the drive voltage adjustment unit, wherein the controller performs control so that the liquid is jetted, and creates a correction data from the jetting characteristic value; and the controller performs control so that the voltage value is corrected based on a value obtained by multiplying the correction data by convergence coefficient within a range from 0.50 or more to less than 1.00, and repeats correcting the voltage value until a detection result of the liquid jetted based on the drive signal after the correction becomes a target value.

21 Claims, 10 Drawing Sheets

LIQUID JETTING DEVICE AND DRIVE VOLTAGE CORRECTION METHOD

BACKGROUND OF THE INVENTION

1. Field of the Invention

The present invention generally relates to a liquid jetting device and a drive voltage correction method for individual drop, and more particularly to a liquid jetting device and a drive voltage correction method used for an ink jet printer to set uniform droplet from all nozzles, a manufacturing apparatus coating a liquid material, and the like.

2. Description of the Related Art

An ink jet printer is generally known as an image recording apparatus recording an image on a recording medium such as paper. A liquid jetting device for jetting ink is installed in an ink jet printer, and the liquid jetting device is equipped with a recording head to jet the ink from a plurality of nozzles, and a drive circuit to drive the recording head.

The recording head is equipped with a jetting energy generating element to each nozzle for jetting ink from each of the plurality of nozzles. As the jetting energy generating element, a heater element generating air bubbles by heat to jet the ink by the pressure of the generated air bubbles, an actuator jetting the ink by deforming to apply a pressure to the ink, and the like are known. Hereinafter, the actuator is exemplified to be described as the jetting energy generating element.

The actuator as the jetting energy generating element is connected to the drive circuit, and is configured to expand and shrink based on a drive signal inputted from the drive circuit for jetting the ink droplet from a nozzle. By the way, even if a drive signal of the same voltage value is applied to each nozzle, the deformation speeds and the deformation rates of the actuators are fluctuated owing to the individual differences of the nozzles, and the fluctuation has been an adverse effect of high-definition image recording as a result. There has been the same adverse effect also in the recording head adopting the heater element as the jetting energy generating element.

For settling the problem, in recent years, a liquid jetting device configured to measure a jetting speed and a jetting quantity to correct the fluctuation among them through drive voltage control based on the measured values has been developed (see, for example, JP-Tokukaihei-7-256884A and JP-Tokukai-2004-90621A). For example, the liquid jetting device (an ink jet printer) described in JP-Tokukaihei-7-256884A is provided with a jetting speed measuring device measuring the jetting speed of the ink droplet from the nozzle, and is configured to correct the voltage value of the drive signal by getting the feedback of a measured value of the jetting speed measuring device. On the other hand, the liquid jetting device described in JP-Tokukai-2004-90621A is provided with a jetting quantity measuring device measuring a jetted ink quantity, and is configured to correct the voltage value of a drive signal by multiplying a measured value of the jetting quantity measuring device by a correction coefficient to converge the measured value.

Here, FIG. 10 is a histogram showing the scattering of drop speeds of the ink droplet which is jetted from a single nozzle 100 times by applying a drive signal of a predetermined voltage value to an actuator. As apparent from FIG. 10, there is a case where the jetting speeds scattering ranges ±0.75% from an average speed (the part of 0% in FIG. 10) even if a drive signal of the same voltage value is applied. That is, in the case where a voltage value is corrected by the liquid jetting device of JP-Tokukaihei-7-256884A, the voltage value is corrected by feeding back a jetting speed decreasing in value by 0.5% (a J part in FIG. 10) or a jetting speed increasing in value by 0.75% (a K part in FIG. 10) as the case may be. If a singular value of a small frequency is used for correction, an accurate correction cannot be performed, and the improvement of the image quality cannot be desired as a result.

Moreover, because there is the fluctuation between nozzles mentioned above also in the jetting quantity similarly in the jetting speed, there is the possibility that a value of a small frequency is used for a correction even in the case where a measured value is multiplied by a correction coefficient as in the liquid jetting device of JP-Tokukai-2004-90621A, and there has been a problem of the accuracy of a correction. In particular, in the case where a singular value of a small frequency is used for a correction, the convergence of values takes a long time and further there is a possibility of diverging without converging even if the multiplication of the correction coefficient is performed.

SUMMARY OF THE INVENTION

It is an object of the present invention to achieve the improvement of image quality by heightening the accuracy of a drive voltage correction.

It is a further object of the present invention to correct drop property variation with an improved correction method.

To solve the above problem, in accordance of the first aspect of the present invention, the liquid jetting device, comprises:

a recording head including a jetting energy generating element to generate a liquid jetting energy for making a nozzle jet liquid;

a drive circuit to generate a drive signal for driving the jetting energy generating element;

a liquid detection sensor to detect a jetting characteristic value of the liquid jetted from the nozzle;

a drive voltage adjustment unit to adjust a voltage value of the drive signal of the drive circuit; and a control unit to control the drive circuit, the liquid detection sensor and the drive voltage adjustment unit, wherein the control unit controls the drive voltage adjustment unit and the drive circuit so that the liquid is jetted from the nozzle, and creates a correction data from the jetting characteristic value of the jetted liquid detected by the liquid detection sensor; and the control unit controls the drive voltage adjustment unit and the drive circuit so that the voltage value of the drive signal is corrected based on a value which is obtained by multiplying the correction data by a convergence coefficient within a range of from 0.50 or more to less than 1.00, and the control unit repeats correcting the voltage value until a detection result of the liquid which was jetted based on the drive signal after the correction by the liquid detection sensor becomes a target value.

In accordance of the second aspect of the present invention, the drive voltage correction method, comprises:

jetting liquid from a nozzle of a recording head by applying a drive signal for driving a jetting energy generating element to the jetting energy generating element generating liquid jetting energy for making the nozzle jet the liquid, by a drive circuit generating the drive signal and by a drive voltage adjustment unit adjusting a voltage value of the drive signal of the drive circuit;

creating a correction data based on a jetting characteristic value of the liquid jetted with a liquid detection sensor;

correcting the voltage value of the drive signal based on a value which is obtained by multiplying the correction data by a convergence coefficient within a range of from 0.50 or more to less than 1.00; and repeating the correcting the voltage value until a detection result of the liquid detection sensor of the liquid jetted based on the drive signal after the correcting becomes a target value.

In accordance of the third aspect of the present invention, the liquid jetting device, comprises:

a recording head including a jetting energy generating element to generate a liquid jetting energy for making a nozzle jet liquid;

a drive circuit to generate a drive signal for driving the jetting energy generating element;

a liquid detection sensor to detect a jetting characteristic value of the liquid jetted from the nozzle;

a drive voltage adjustment unit to adjust a voltage value of the drive signal of the drive circuit; and a control unit to control the drive circuit, the liquid detection sensor and the drive voltage adjustment unit, wherein the control unit controls the drive voltage adjustment unit and the drive circuit so that the liquid is jetted by the same drive signal from the nozzle a plurality of times, and creates a correction data based on jetting characteristic values of the liquid jetted the plurality of times by the liquid detection sensor; and the control unit controls the drive voltage adjustment unit and the drive circuit so that the voltage value of the drive signal is corrected based on the correction data, and repeats correcting the voltage value until a detection result of the liquid detection sensor of the liquid jetted based on the drive signal after the correction becomes a target value.

In accordance of the fourth aspect of the present invention, the drive voltage correction method, comprises:

jetting liquid from a nozzle of a recording head a plurality of times by applying a same drive signal for driving a jetting energy generating element a plurality of times to the jetting energy generating element generating liquid jetting energy for making the nozzle jet the liquid, by a drive circuit generating the drive signal and by a drive voltage adjustment unit adjusting a voltage value of the drive signal of the drive circuit;

creating a correction data based on jetting characteristic values of the liquid jetted the plurality of times with a liquid detection sensor;

correcting the voltage value of the drive signal based on the correction data; and repeating the correcting the voltage value until a detection result of the liquid detection sensor of the liquid jetted based on the drive signal after the correcting becomes a target value.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS

First Embodiment

Figure 1:
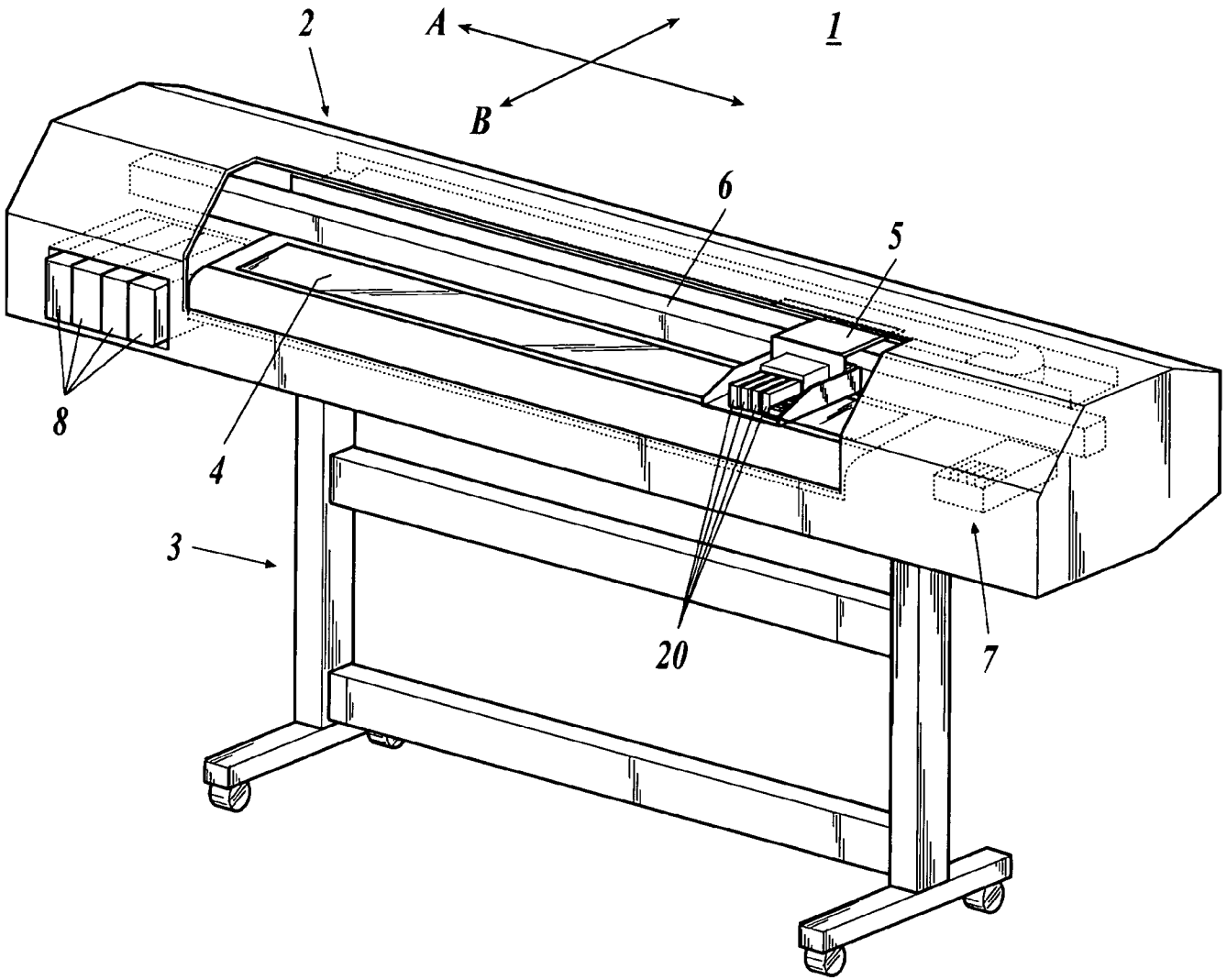
FIG. 1 is a perspective view showing an ink jet printer comprising a liquid jetting device according to a first embodiment.

FIG. 1 is a perspective view showing the schematic configuration of an ink jet printer of a first embodiment to which a liquid jetting device according to the present invention is applied. As shown in FIG. 1, the ink jet printer 1 comprises a printer main body 2 and a supporting pedestal 3 supporting the printer main body 2 from the lower side. In the inside of the printer main body 2, a tabular platen 4 long in the lateral direction is provided. The platen 4 evenly supports a sheet-like recording medium from the lower side.

In FIG. 1, although the recording medium on which an image is recorded is not shown, the recording medium is fed in from a carry-in port formed on the back face of the printer main body 2, and passes the inside of the printer main body 2 from the back to the front in the state of being supported on the platen 4 by a conveyance mechanism, which is provided in a prescribed location in the inside of the printer main body 2, to be carried out to the outside of the printer main body 2. That is, the recording medium is conveyed in a conveyance direction B by the conveyance mechanism so that the recording medium may pass the inside of the printer main body 2.

The conveyance mechanism comprises, for example, a conveyance motor, conveyance rollers and the like, which are not shown, and is configured to convey the recording medium by rotating the conveyance rollers by the drive of the conveyance motor. The conveyance mechanism is configured to convey the recording medium intermittently by repeating the conveyance and the stop of the recording medium with the operation of a carriage 5, which will be described later, at the time of image recording.

Above the platen 4, a guide member 6 extending in the lateral direction in the inside of the printer main body 2 is provide in a prescribed location as shown in FIG. 1. The carriage 5 is supported by the guide member 6, and the carriage 5 is configured to be freely movable laterally by being guided by the guide member 6. Moreover, the ink jet printer 1 is configured so that a drive mechanism (not shown) moves the carriage 5 along the guide member 6. In the following, the direction in which the carriage 5 moves is set to a scanning direction A to be described.

Moreover, a maintenance unit 7 for maintaining a plurality of recording heads 20 mounted on the carriage 5 is provided on the right side of the platen 4 in the scanning direction A. The maintenance unit 7 is provided on the lower side of the carriage 5 in the moving range of the carriage 5.

Moreover, on the left side of the platen 4 in the scanning direction A, a plurality of ink tanks 8 storing ink are provided in a prescribed location.

Figure 2:
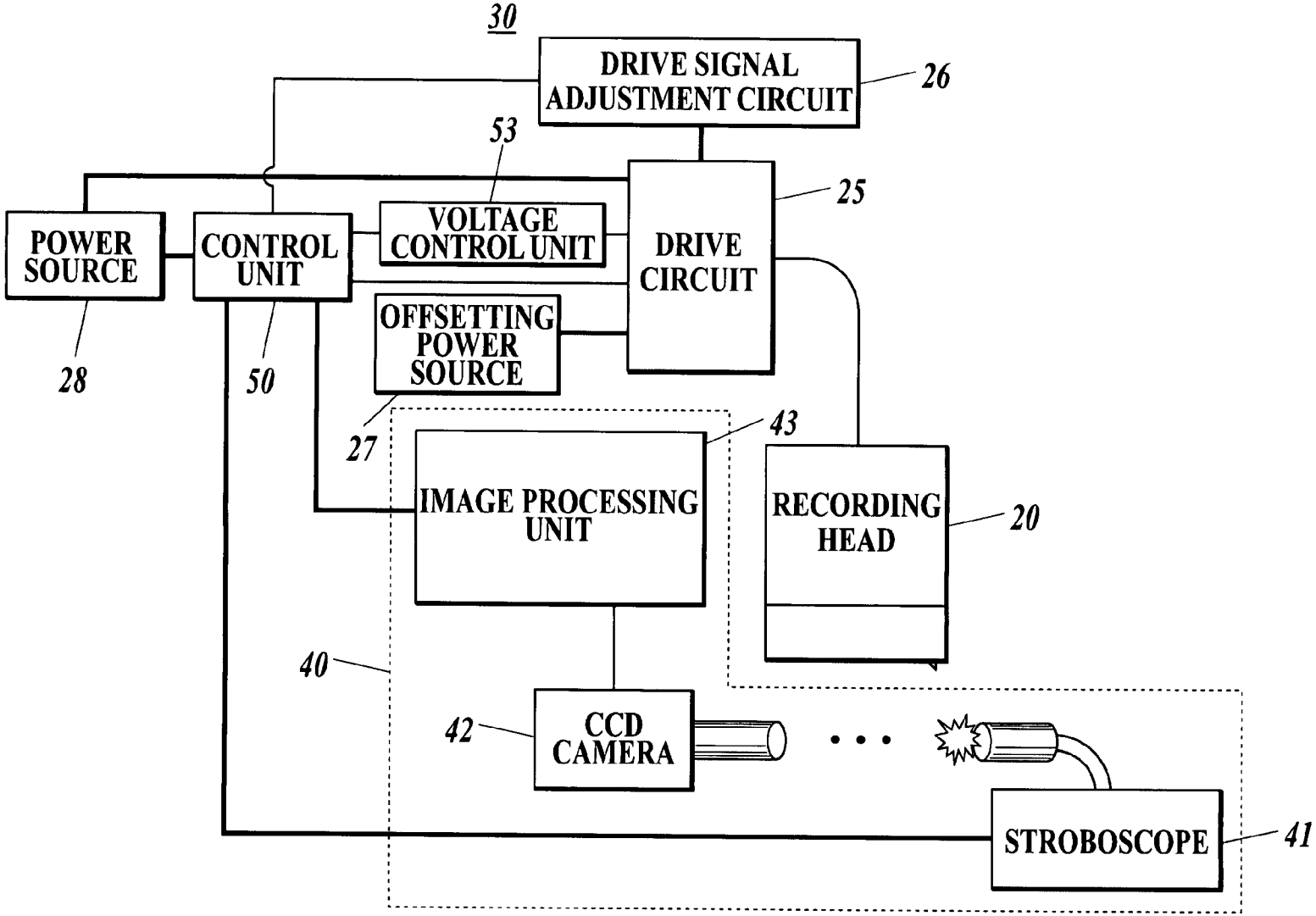
FIG. 2 is a block diagram showing a main configuration of the liquid jetting device according to the first embodiment.

A liquid jetting device 30 for jetting ink (liquid) to a recording medium is provided in the ink jet printer 1 as shown in FIG. 2. The liquid jetting device 30 comprises the plurality of recording heads 20 jetting ink, a drive circuit 25 generating drive signals for driving the recording heads 20, a drive signal adjustment circuit 26 adjusting the waveforms of the drive signals, a voltage control unit (drive voltage adjustment unit) 53 adjusting the voltage values of the drive signals, a liquid detection sensor 40 detecting the jetting speed of the ink jetted from the recording heads 20, a control unit 50 controlling the drive circuit 25, the drive signal adjustment circuit 26, the voltage control unit 53 and the liquid detection sensor 40, and a power source 28 which supplies electric power to the control unit 50 and the drive signal adjustment circuit 26.

Figure 3:
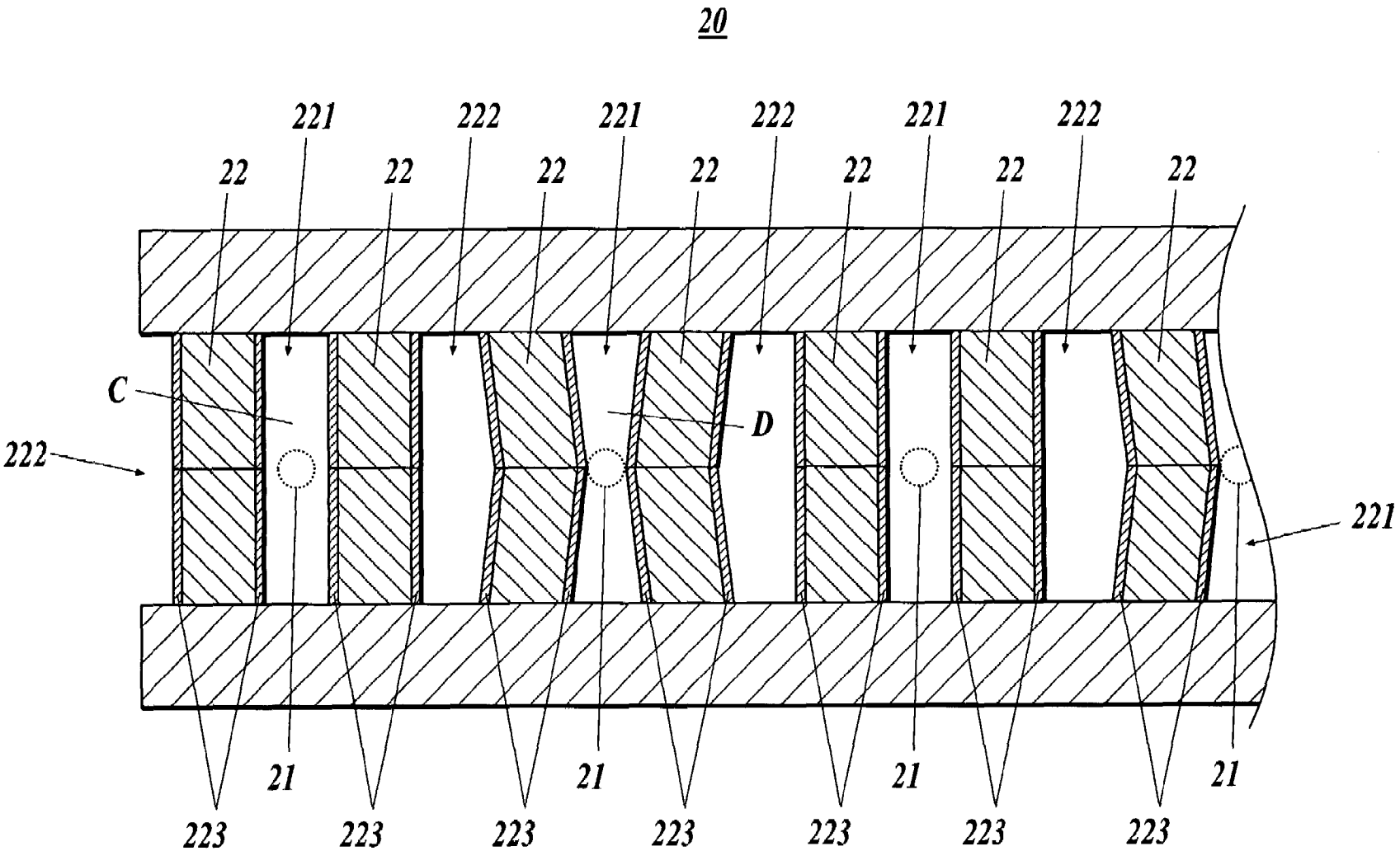
FIG. 3 is a sectional view of a recording head equipped in the liquid jetting device of FIG. 2.

As shown in FIG. 1, the plurality of recording heads 20 is mounted on the carriage 5 along the scanning direction A. FIG. 3 is a sectional view of the recording head 20. A plurality of nozzles 21 jetting the ink to a recording medium is linearly arranged on the nozzle-plate of the recording head 20. In order to jet the ink from each of the plurality of nozzles 21, the recording head 20 is provided with actuators 22, such as piezoelectric elements, which generate liquid jetting energy to each of the nozzles 21.

In the actuators 22, a plurality of parallel liquid flow path grooves 221 guiding ink to each of the plurality of nozzles 21 is formed. Furthermore, a no-liquid groove 222, which is parallel to the liquid flow path grooves 221, and in which any ink does not flow, is formed between each liquid flow path groove 221 in the actuators 22. Then, electrodes 223 connected to the drive circuit 25 are provided on the inner side surfaces of the liquid flow path grooves 221 and the no-liquid grooves 222. When a drive signal generated by the drive circuit 25 is supplied to the electrodes 223, the electrodes 223 apply a voltage based on the drive signal to an actuator 22. Therefore, the actuator 22 is configured to deform according to the voltage. The actuator 22 deforms so as to perform shearing deformation with a change of the voltage, and a liquid flow path groove 221 is made to be expanded and shrunk by the deformation. Because the inside of the liquid flow path groove 221 becomes a negative pressure at the time of an expand, ink is led into the liquid flow path groove 221. Because the inside of the liquid flow path groove 221 becomes a positive pressure at the time of a shrinkage, the ink in the liquid flow path groove 221 is jetted from the nozzle 21. In FIG. 3, a C part shows the liquid flow path groove 221 at an ordinary time, and a D part shows the liquid flow path groove 221 at a shrinkage time. Thus, because the pressure change at the shrinkage time operates as the liquid jetting energy, the liquid jetting energy is generated by the shearing mode deformation of the actuator 22.

As shown in FIG. 2, the liquid detection sensor 40 comprises a stroboscope 41 radiating light to an ink droplet jetted from the nozzle 21, a CCD camera 42 photographing the ink droplet based on the irradiated light from the stroboscope 41, and an image processing unit 43 performing image processing to the image data acquired by the photographing of the CCD camera 42 to detect the jetting speed of the ink. The stroboscope 41 and the CCD camera 42 are provided near the maintenance unit 7, and it is made to be possible to photograph the ink jetted toward the maintenance unit 7.

The control unit 50 is configured to create and output control signals to the drive circuit 25, the drive signal adjustment circuit 26 and the voltage control unit 53 based on a detection result of the liquid detection sensor 40. Moreover, the conveyance mechanism conveying a recording medium, the drive mechanism scanning the carriage 5, and the like are connected to the control unit 50.

The drive signal adjustment circuit 26 is configured to acquire the waveform of the drive signal for driving the actuator 22 based on a control signal from the control unit 50, and to create an adjustment signal based on the waveform to output the adjustment signal.

Figure 4:
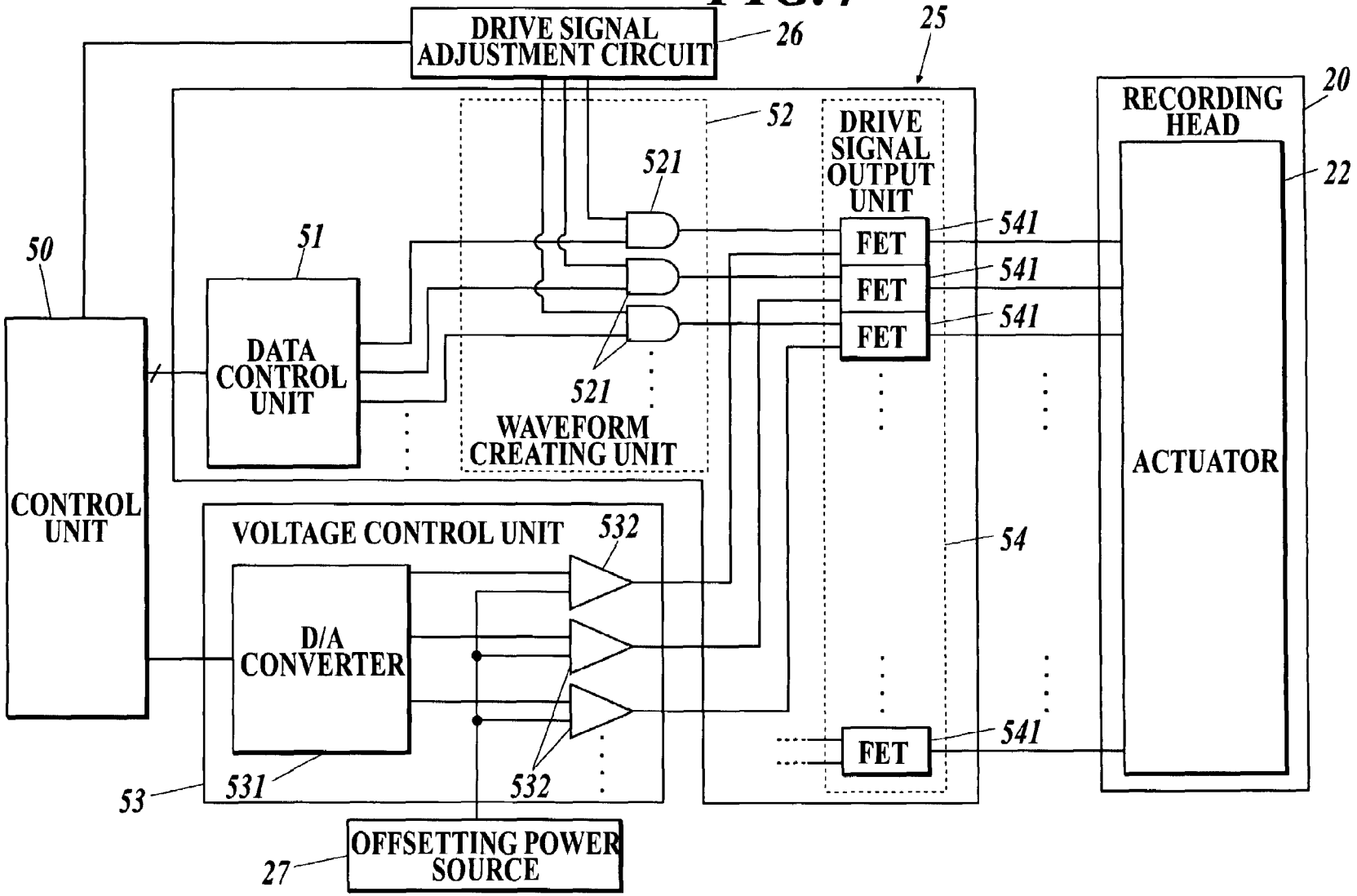
FIG. 4 is a circuit diagram showing a schematic configuration of a drive circuit equipped in the liquid jetting device of FIG. 2.

FIG. 4 is a circuit diagram showing the schematic configuration of the drive circuit 25. As shown in FIG. 4, the drive circuit 25 is provided with a data control unit 51 connected with the control unit 50 to output a drive signal of a waveform based on a control signal from the control unit 50. A waveform creating unit 52 creating the waveforms of the drive signals corresponding to the actuators 22 is connected to the data control unit 51. A plurality of AND elements 521 are installed in the waveform creating unit 52 correspondingly to each nozzle 21. The AND elements 521 are configured so that the data control unit 51 and the drive signal adjustment circuit 26 are connected to the input terminals of the AND elements 521, and that the drive signals from the data control unit 51 and the adjustment signals from the drive signal adjustment circuit 26 are inputted into the AND elements 521. Thereby, the inputted signals are synthesized in the AND elements 521, and then the drive signals of the waveforms necessary for driving are outputted from the AND elements 521.

On the other hand, the voltage control unit 53 is connected with the control unit 50, and determines a voltage value based on the control signal from the control unit 50. The voltage control unit 53 is provided with a D/A converter 531 converting the control signal from the control unit 50 into an analog signal, and a plurality of amplifiers 532 for amplifying the analog signal from the D/A converter 531 to a predetermined voltage value so as to correspond to each nozzle 21. An offsetting power source 27 supplying offsetting electric power and the D/A converter 531 are connected to the input terminals of the amplifiers 532.

Then, the drive circuit 25 is provided with a drive signal output unit 54 for synthesizing the drive signals from the waveform creating unit 52 and the voltage values from the voltage control unit 53 to generate a drive signal of an independent waveform to each nozzle 21. The drive signal output unit 54 is provided with a plurality of FET elements 541. To the input terminal of each of the FET elements 541, an output terminal of an AND element 521 of the waveform creating unit 52 and an output terminal of an amplifier 532 of the voltage control unit 53 are severally connected. To the output terminal of each of the FET elements 541, the electrode 223 of the actuator 22 is connected. Thereby, the FET element 541 is configured to synthesize the drive signal from the waveform creating unit 52 and the voltage value from the voltage control unit 53 to every nozzle 21, and to output the synthesized signal to the electrode 223 of the actuator 22.

The control unit 50 controls the drive circuit 25 and the voltage control unit 53 to output at least two or more drive signals of different voltage values to the actuator 22, and makes the nozzle 21 to be corrected jet a plurality of ink droplets at the time of a correction of the drive voltage. At this time, the liquid detection sensor 40 detects the jetting speeds of the plurality of ink droplets jetted from the nozzle 21, and outputs the detection result to the control unit 50. The control unit 50 calculates a voltage correction coefficient $\alpha$ used for the correction calculation of the drive voltage based on the detection result from the liquid detection sensor 40. For example, in the case where the actuator 22 is driven by two drive signals of different voltage values and two ink droplets are jetted, and when it is supposed that the jetting speed of a first ink droplet is denoted by $V_{e1}$ and a first voltage value is dented by $V_{O1}$, and that the jetting speed of a second ink droplet is denoted by $V_{e2}$ and a second voltage value is denoted by $V_{O2}$, the voltage correction coefficient $\alpha$ is expressed as "$\alpha=(V_{01}-V_{02})/(V_{e1}-V_{e2})$.

Figure 5:
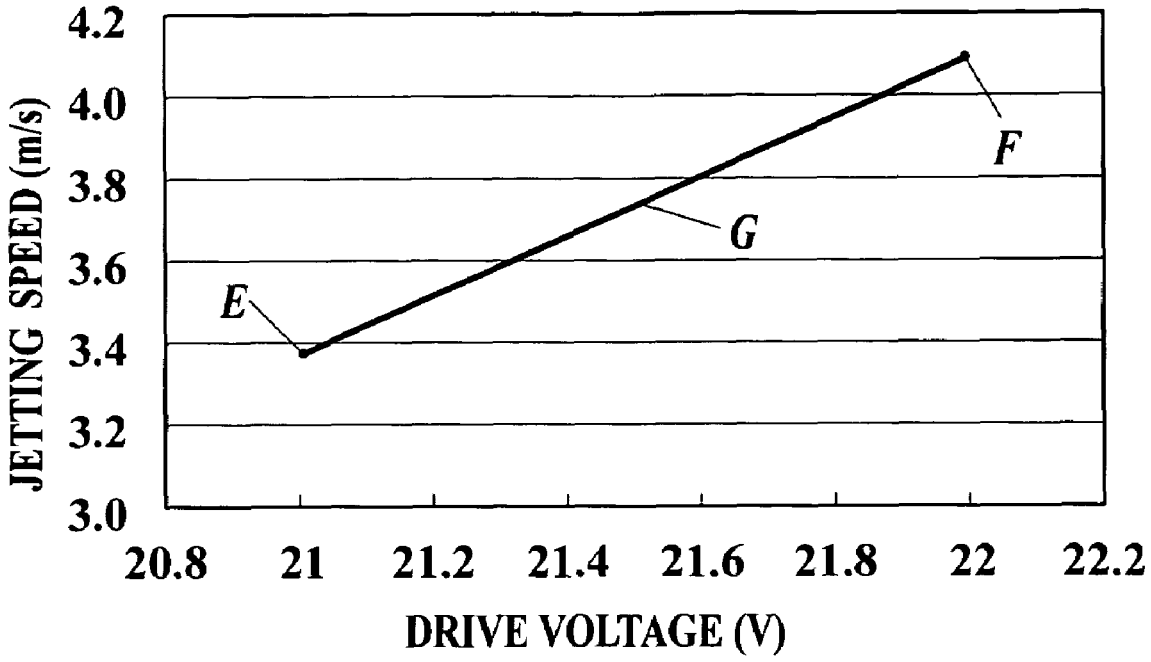
FIG. 5 is a drive voltage-jetting speed diagram in the recording head of FIG. 3.

The correction operation of the control unit 50 is next described concretely using a drive voltage-jetting speed diagram of FIG. 5. The following case is supposed. That is, the drive signal having the voltage value $V_{01}$ of 21 V and a drive signal having the voltage value $V_{02}$ of 22 V are outputted to the actuator 22 to make the nozzle 21 jet two ink droplets. The jetting speed $V_{e1}$ of the first ink droplet is 3.38 m/s (an E point in FIG. 5). The jetting speed $V_{e2}$ of the second ink droplet is 4.08 m/s (an F point in FIG. 5). In such a case, because of $\alpha=(V_{O1}-V_{02})/(V_{e1}-V_{e2})$, $\alpha=(21-22)/(3.38-4.08)=1.43$. The voltage correction coefficient $\alpha$ is an inverse number $1/\gamma$ of the inclination $\gamma$ of a straight line G connecting the E point and the F point.

Then, the control unit 50 controls the drive circuit 25 and the voltage control unit 53 to make them output a drive signal of a predetermined voltage value to the actuator 22, and then makes the nozzle 21 jet one ink droplet. At this time, the control unit 50 calculates a difference voltage value (correction data) $\Delta V$ to a target value from a jetting speed $V_{er}$ of the ink droplet detected by the liquid detection sensor 40, a voltage value $V_{0p}$ at the time of the jetting, a target value $V_{eg}$ of the jetting speed, and the voltage correction coefficient $\alpha$. The difference voltage value $\Delta V$ is expressed by "$\Delta V=(V_{eg}-V_{er})\times\alpha$." Then, in order to make it easy to converge the jetting speed to the target speed $V_{eg}$ of the jetting speed, the control unit 50 multiplies the difference voltage value $\Delta V$ by a convergence coefficient $\beta$, which is set within a range of from 0.50 or more to less than 1.00. Then, the control unit 50 adds the multiplied value to a voltage value $V_{0p}$ at the jetting to calculate a correction voltage value $V_{0r}$. That is, the control unit 50 calculates the correction voltage value $V_{0r}$ as follows: "$V_{0r}=V_{0p}+\Delta V\times\beta=V_{0p+(Veg}-V_{er})\times\alpha\times\beta$."

After that, the control unit 50 controls the drive circuit 25 and the voltage control unit 53 to make them output the drive signal of a correction voltage value $V_{0r}$ to the actuator 22, and makes the nozzle 21 jet one ink droplet. At this time, when the jetting speed of the ink droplet detected by the liquid detection sensor 40 is within a predetermined allowable error range from the target value, the control unit 50 completes the correction of the drive voltage. When the jetting speed of the ink droplet is out of the allowable error range from the target value, the control unit 50 calculates the difference voltage value $\Delta V$ and the correction voltage value $V_{0r}$ by setting the voltage value and the jetting speed at the nearest preceding time of ink jetting as the voltage value $V_{0p}$ and the jetting speed $V_{er}$, respectively, and the control unit 50 again makes the nozzle 21 jet one ink droplet by means of the obtained correction voltage value $V_{0r}$. If these processes are repeated, because the correction voltage value $V_{0r}$ before attaining the target value is reflected in subsequent processes, the jetting speed gradually approaches the target value, and finally enters within the allowable error range. Thus, the corrected drive voltage value is determined.

Next, the image recording and the drive voltage correction method which are performed in the ink jet printer 1 are described.

When the image recording is started, the control unit 50 controls the conveyance mechanism to convey a recording media intermittently. At the intermittent conveyance time, the control unit 50 controls the drive mechanism and the drive circuit 25 to scan the carriage 5 while making the recording heads 20 jet ink to the recording medium with the timing of the stops of the recording medium. By repeating the operation, an image is recorded on the recording medium.

Next, at the time of the correction of the drive voltages, the control unit 50 controls the drive mechanism to make the drive mechanism move the carriage 5 onto the maintenance unit 7, and then the control unit 50 starts the correction processing of the drive voltages.

Figure 6:
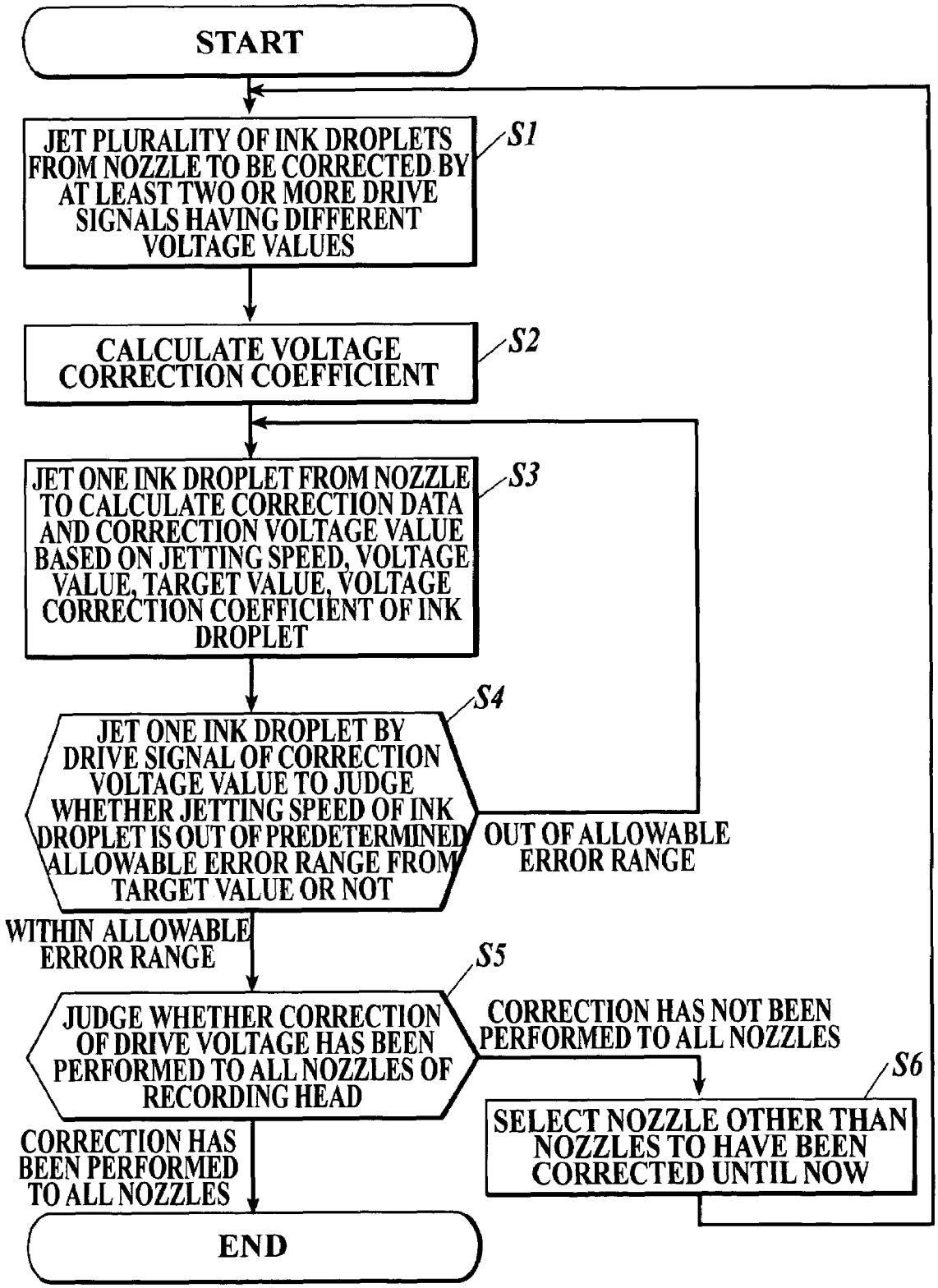
FIG. 6 is a flowchart showing a correction processing of a drive voltage performed in the liquid jetting device of FIG. 2.

FIG. 6 is a flowchart of the correction processing of the drive voltages. As shown in FIG. 6, when the correction processing is started, the control unit 50 makes at least two or more drive signals of different voltage values be outputted to an actuator 22, and makes the nozzle 21 to be corrected jet a plurality of ink droplets (Step S1).

At Step S2, the control unit 50 calculates a voltage correction coefficient $\alpha$ based on the detection results of the plurality of jetted ink droplets from the liquid detection sensor 40.

At Step S3, the control unit 50 makes the nozzle 21 jet one ink droplet, and the control unit 50 calculates a difference voltage (correction data) $\Delta V$ to a target value and a correction voltage value $V_{0r}$ based on the jetting speed $V_{er}$ of the ink droplet detected by the liquid detection sensor 40, the voltage value $V_{0p}$ at the time of the jetting, the target value $V_{eg}$ of the jetting speed, and the voltage correction coefficient $\alpha$.

At Step S4, the control unit 50 makes the drive signal of the correction voltage value $V_{0r}$ be outputted to the actuator 22, and makes the nozzle 21 jet one ink droplet. At this time, when the jetting speed of the ink droplet detected by the liquid detection sensor 40 is out of the predetermined allowable error range from the target value, the processing of the control unit 50 shifts to Step S3. When the jetting speed of the ink droplet is within the predetermined allowable error range, the processing of the control unit 50 shifts to Step S5.

When the processing of the control unit 50 has shifted from Step S4 to Step S3, the control unit 50 calculates the difference voltage value (correction data) $\Delta V$ and the correction voltage value $V_{0r}$ by setting the voltage value and the jetting speed at the time of ink jetting at Step S4 as the voltage value $V_{0p}$ and the jetting speed $V_{er}$. That is, the correction voltage value $V_{0r}$ before attaining the target value is reflected in the subsequent processes. Consequently, if the Steps S3-S4 are repeated, the jetting speed gradually approaches the target value, and finally is within the allowable error range. Thus, the corrected drive voltage value is determined.

At Step S5, the control unit 50 judges whether the correction of the drive voltage has been performed to all the nozzles 21 of the recording heads 20 or not. When the correction of the drive voltage has not been performed to all the nozzles 21, the processing of the control unit 50 shifts to Step S6.

At Step S6, a nozzle 21 other than the nozzles 21 which have become the correction objects until now is selected, and the processing of the control unit 50 shifts to Step S1.

When the control unit 50 judges that the correction of the drive voltage has been performed to all the nozzles 21 at Step S5, the control unit 50 ends the correction processing of the drive voltages.

In the drive voltage correction method described above, the detection of the jetting speed by the liquid detection sensor 40 may be performed to the nozzle 21 to be corrected by jetting ink from all the nozzles 21 including the nozzles 21 which are not the correction objects in addition to the nozzle 21 to be corrected. Moreover, the nozzle 21 to be corrected may be plural.

Thus, droplet speed from individual nozzle can be controlled through independently corrected pulse. Then, a droplet placement error becomes minimum.

Figure 7:
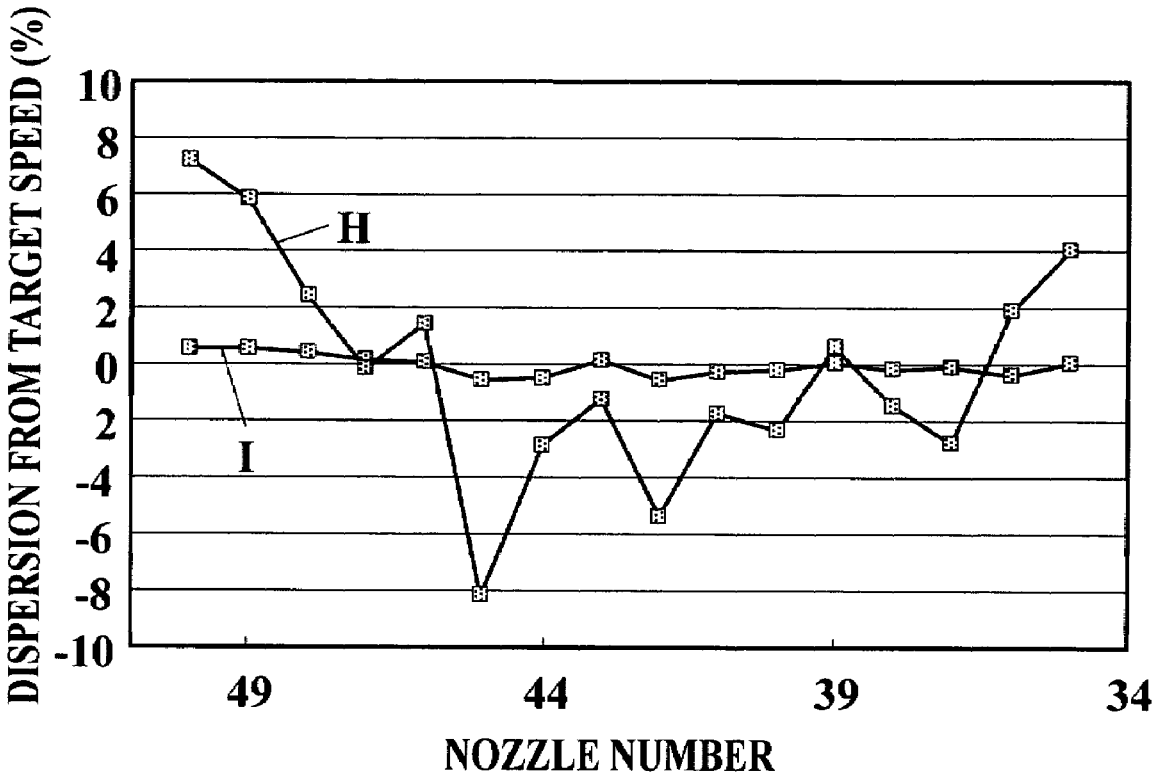
FIG. 7 is a graph showing fluctuation in a jetting speed of each nozzle to a target value in the liquid jetting device of FIG. 2.

FIG. 7 is a graph showing the fluctuation of the jetting speeds of the respective nozzles 21 to the target value. A polygonal line H expresses the fluctuation of the jetting speeds without the drive voltage correction processing, and a polygonal line I expresses the dispersion in the jetting speeds with the drive voltage correction processing. Incidentally, in FIG. 7, the results of the examination of the fluctuation of the jetting speeds about a 35th to a 50th nozzle 21 among the plurality of nozzles 21 equipped in a recording head 20 are expressed. As it is found also in FIG. 7, the jetting speeds are fluctuated over ±8% of range to the target value without the drive voltage correction processing. However, because the jetting speeds are corrected with the drive voltage correction processing, the fluctuation is suppressed within ±0.8%.

As described above, according to the liquid jetting device 30 of the present embodiment, the voltage value of the drive signal is corrected based on the correction value obtained by multiplying the difference voltage value as the correction data of the present invention by the convergence coefficient within a range of from 0.5 or more to less than 1.00, and adding the multiplied difference voltage value to the drive voltage value at the time of measuring the jetting speed of the ink droplet. Consequently, even when the correction voltage value becomes likely to diverge to the target value, the correction voltage value converges on the target value. Thereby, even if the correction voltage value has been created based on a singular value, the accuracy of the drive voltage correction can be improved, and as a result the image quality can be improved.

Figure 8:
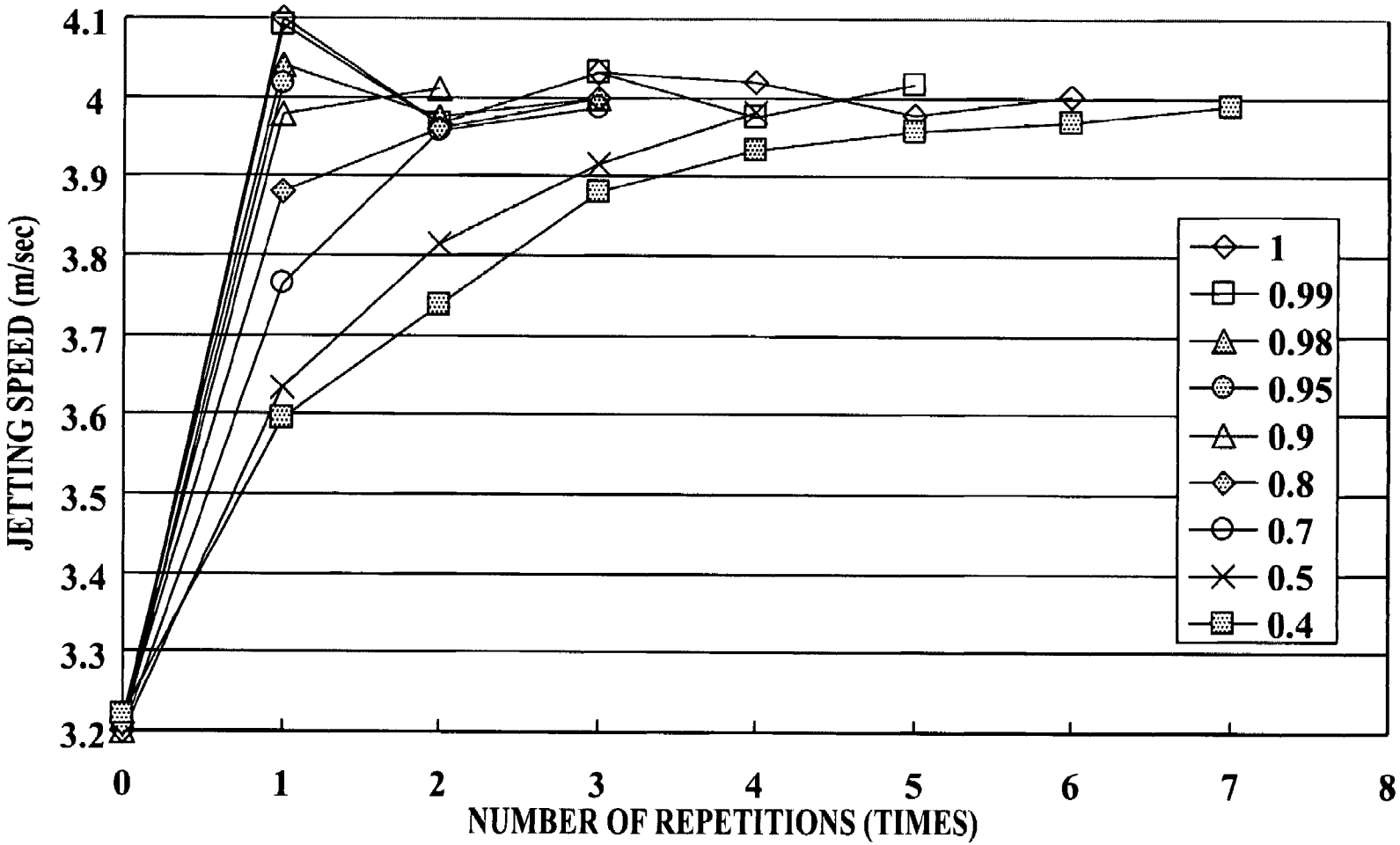
FIG. 8 is a graph showing experimental results in an experiment of changing convergence coefficients used in the correction processing of the drive voltage of FIG. 5 stepwise.

Here, as mentioned above, the convergence coefficient is set within a range of from 0.50 or more to less than 1.00. However, the number of trial repetitions at the time of the drive voltage correction processing is preferably smaller because the processing time can be shortened. Accordingly, the inventors of the present invention performed experiments to acquire the optimum convergence coefficient. In the experiments hereupon, the ink jet printer 1 described above was used. The target value of the jetting speed was set to 4 m/s, and the allowable error range was set to ±0.5%. The drive voltage correction processing was performed by changing the convergence coefficient at nine steps of 1.00, 0.99, 0.98, 0.95, 0.90, 0.80, 0.70, 0.50 and 0.40. FIG. 8 is a graph showing the experimental results, and shows the numbers of times of repetitions at which the correction voltage values converged within the allowable error range at every step. As can be found from FIG. 8, the numbers of trial repetitions necessary for the convergence of the correction voltage values within the allowable error range of the target value are as follows. That is, when the convergence coefficient is 1.00, the number of repetitions is six times. When the convergence coefficient is 0.99, the number of repetitions is five times. When the convergence coefficient is 0.98, the number of repetitions is four times. When the convergence coefficient is 0.95, the number of repetitions is two times. When the convergence coefficient is 0.90, the number of repetitions is three times. When the convergence coefficient is 0.80, the number of repetitions is four times. When the convergence coefficient is 0.70, the number of repetitions is four times. When the convergence coefficient is 0.50, the number of repetitions is five times. When the convergence coefficient is 0.40, the number of repetitions is seven times. From the results, when the convergence coefficient is 1.00 or 0.40, the number of repetitions becomes six times or more. Because it is desired from the view of time that the number of repetitions is five times or less, the convergence coefficient is preferably within a range of from 0.50 to 0.99 both inclusive. Furthermore, the smaller the number of repetitions is, the much the processing time can be shortened. Consequently, the range of the number of repetitions of four times or less, namely the convergence coefficient being within a range of from 0.70 to 0.98 both inclusive is further preferable.

Based on these facts, the inventors of the present invention performed various experiments, and found that it is possible to decrease the number of times of corrections until the jetting speed becomes the target value when the convergence coefficient is 0.99 or less. That is, as long as the convergence coefficient is 0.99 or less, the number of times of correction can be reduced, and it becomes possible to shorten the time necessary for the correction.

Moreover, the inventors of the present invention found that the number of times of correction until the jetting speed becomes the target value can be reduced furthermore when the convergence coefficient is 0.70 or more. That is, when the convergence coefficient is 0.70 or more, the number of times of correction can be reduced, and it becomes possible to shorten the time necessary for the correction.

Furthermore, the inventors of the present invention found that the number of times of correction until the jetting speed becomes the target value can be reduced furthermore when the convergence coefficient is 0.98 or less. That is, when the convergence coefficient is 0.98 or less, the number of times of correction can be reduced, and it becomes possible to shorten the time necessary for the correction furthermore.

Moreover, because the correction data is created from the jetting characteristic values of the liquid jetted a plurality of times, values displaced to the + side from a reference value and values displaced to the − side from the reference value are included in the plurality of times of the jettings, and the displaced values are canceled at the time of the creation of correction data. Thereby, the reliability of the correction data is heightened and the divergence from a target value at the time of correction can be prevented.

Then, it is desirable to create the correction data based on the mean value of the jetting characteristic values of the liquid jetted a plurality of times detected by the liquid detection sensor 40. Thus, if correction data is created based on the mean value of a plurality of jetting characteristic values acquired by a plurality of times of liquid jetting, the correction data can be prevented from being created based on a singular value, and the accuracy of the correction data can be improved.

Although one ink droplet is made to be jetted from the nozzle 21 at the time of measuring the jetting speed of the ink droplet by the liquid detection sensor 40 in the present embodiment, a plurality of ink droplets may be made to be jetted and one of the ink droplets may be measured.

Second Embodiment

Figure 9:
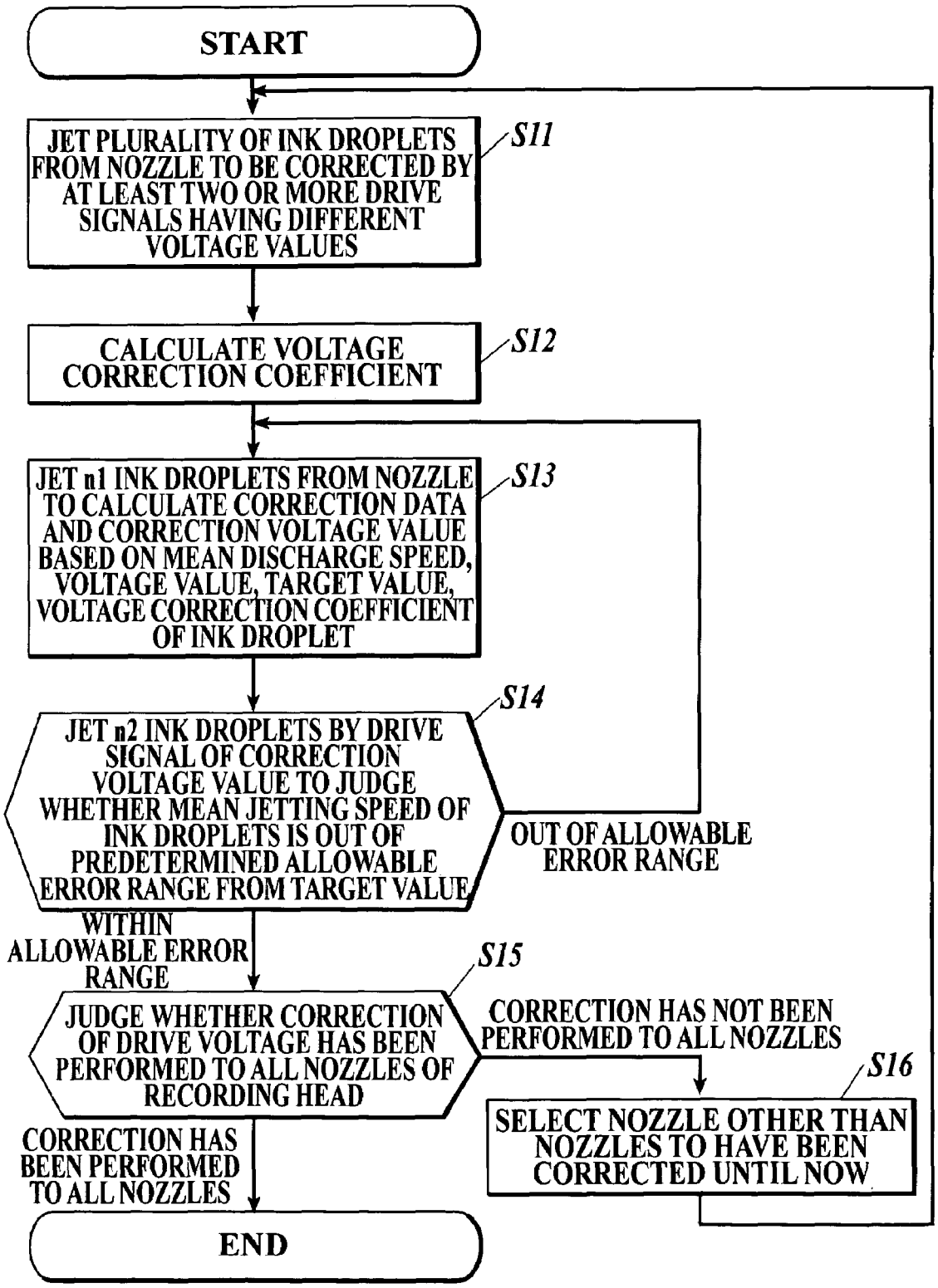
FIG. 9 is a flowchart of a correction processing of a drive voltage performed in a liquid jetting device of a second embodiment.
Figure 10:
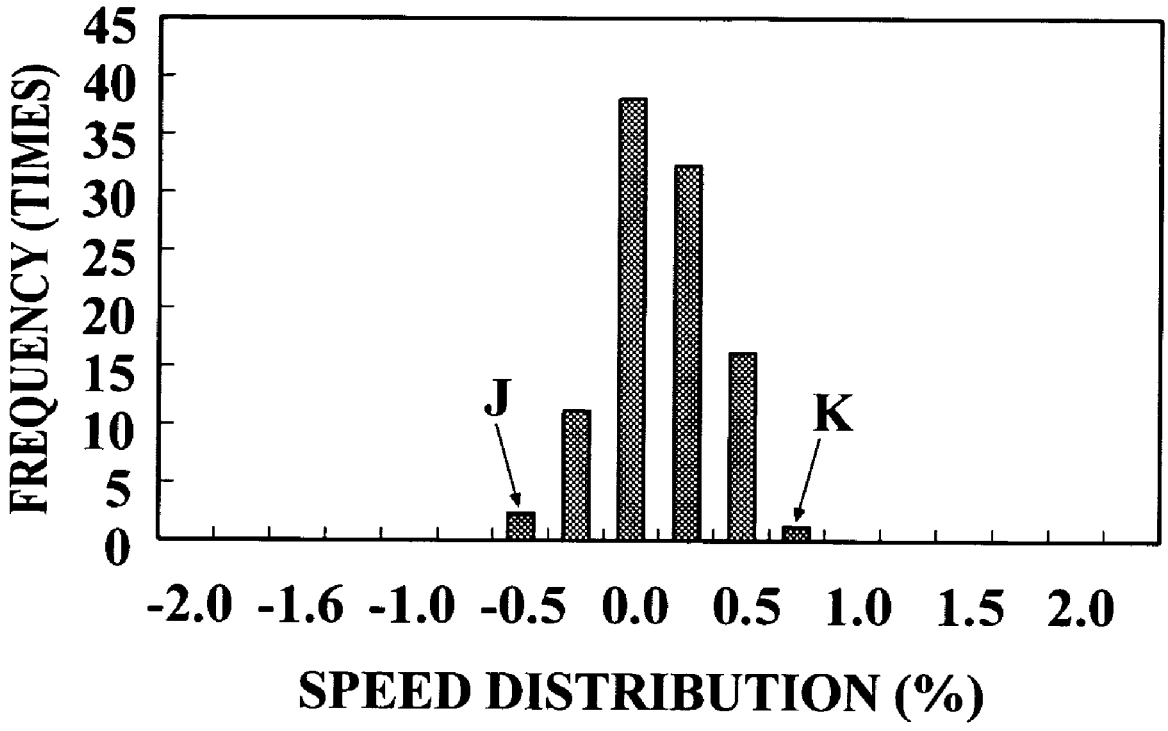
FIG. 10 is a histogram showing scattering of jetting speeds of the ink which is jetted from a single nozzle 100 times by applying a drive signal of a predetermined voltage value to an actuator.

FIG. 9 is hereinafter referred to while a liquid jetting device according to the second embodiment is described. FIG. 9 is a flowchart showing a drive voltage correction method in the liquid jetting device according to the second embodiment. In the above-mentioned liquid jetting device according to the first embodiment, the drive voltage correction method in which correction is performed based on the correction voltage value acquired by adding the difference voltage value multiplied by the convergence coefficient to the drive voltage value at the time of measuring the jetting speed of an ink droplet has been described. But, in the second embodiment, a drive voltage correction method which can improve the accuracy of a drive voltage correction without using any convergence coefficient is described. In the following description, the same portions as those of the first embodiment are denoted by the same reference characters as those of the first embodiment, and the descriptions of the same portions are omitted.

As shown in FIG. 9, when the correction processing is started, the control unit 50 controls the drive circuit 25 and the voltage control unit 53 to make them output at least two or more drive signals of different voltage values to the actuator 22, and to make the nozzle 21 to be corrected jet a plurality of ink droplets. At this time, the liquid detection sensor 40 detects the jetting speeds of the plurality of ink droplets jetted from the nozzle 21 to output the detected result to the control unit 50 (Step S11).

At Step S12, the control unit 50 calculates the voltage correction coefficient $\alpha$ used for the correction calculation of the drive voltages based on the detection result from the liquid detection sensor 40.

At Step S13, the control unit 50 controls the drive circuit 25 and the voltage control unit 53 to make them output the drive signal of a predetermined voltage value to the actuator 22, and to make the nozzle 21 jet an ink droplet a plurality of times ($n_1$ times). At this time, the control unit 50 calculates the difference voltage value (correction data) $\Delta V$ to the target value and the correction voltage value $V_{0r}$ based on a mean jetting speed $V_{eA}$ of the ink droplets for $n_1$ times detected by the liquid detection sensor 40, the voltage value $V_{0p}$ at the time of the jetting, the target value $V_{eg}$ of the jetting speed, and the voltage correction coefficient $\alpha$. The difference voltage value $\Delta V$ can be expressed by "$\Delta V=(V_{eg}-V_{er})\times\alpha$", and the correction voltage value $V_{0r}$ can be expressed by "$V_{0r}=V_{0p}+\Delta V=V_{0p}+(V_{eg}-V_{er})\times\alpha$."

At Step S14, the control unit 50 controls the drive circuit 25 and the voltage control unit 53 to make them output the drive signal of the correction voltage value $V_{0r}$ to the actuator 22, and to make the nozzle 21 jet one ink droplet $n_2$ times. At this time, when the mean jetting speed of the ink droplets for $n_2$ times detected by the liquid detection sensor 40 is out of the predetermined allowable error range from the target value, the processing of the control unit 50 shifts to Step S13. When the mean jetting speed of the ink droplets is within the predetermined allowable error range, the processing of the control unit 50 shifts to Step S15.

When the processing of the control unit 50 has shifted from Step S14 to Step S13, the control unit 50 calculates the difference voltage value (correction data) $\Delta V$ and the correction voltage value $V_{0r}$ by setting the voltage value and the jetting speed at the time of ink jetting at Step S14 as the voltage value $V_{0p}$ and the jetting speed $V_{er}$. That is, the correction voltage value $V_{0r}$ before attaining the target value is reflected in the subsequent processes. Consequently, if the Steps S3-S4 are repeated, the jetting speed gradually approaches the target value, and finally is within the allowable error range. Thus, the corrected drive voltage value is determined.

At Step S15, the control unit 50 judges whether the correction of the drive voltage has been performed to all the nozzles 21 of the recording heads 20 or not. When the correction of the drive voltage has not been performed to all the nozzles 21, the processing of the control unit 50 shifts to Step S16.

At Step S16, a nozzle 21 other than the nozzles 21 which have become the correction objects until now is selected, and the processing of the control unit 50 shifts to Step S11.

When the control unit 50 judges that the correction of the drive voltage has been performed to all the nozzles 21 at Step S15, the control unit 50 ends the correction processing of the drive voltages.

As described above, according to the liquid jetting device of the second embodiment, because the correction voltage value as the correction data of the present invention is created based on the jetting speeds of the ink jetted at a plurality of times, values displaced to the + side from a reference value and values displaced to the − side from the reference value are included in the plurality of times of the jettings, and the displaced values are canceled at the time of the creation of the correction voltage values. Thereby, because the reliability of the correction voltage value is heightened, it becomes possible to improve the accuracy of the drive voltage correction in comparison with the case where the jetting speed of the once jetted liquid is fed back to correct the voltage value, and consequently it becomes possible to improve the image quality.

Although the ink droplet is jetted a plurality of times only at the time of the ink jetting at Steps S13 and S14, and the correction voltage value is calculated based on the mean jetting speed of the ink droplets or it is judged whether the mean jetting speed is within the allowable error range or not in the second embodiment, if an ink droplet is made to be jetted a plurality of times ($n_3$ times) and the voltage correction coefficient is calculated from the mean jetting speed of the ink droplets also at Step S12, the accuracy of the voltage correction coefficient itself also can be improved.

Moreover, when the voltage correction coefficient is calculated, the jetting speeds of the ink droplets by three or more different drive voltages may be detected with the liquid detection sensor 40, and an approximate straight line of the relation of the detected jetting speeds and the drive voltages may be acquired by the least-square method or the like. Then, by adopting the inverse number of the inclination of the straight line as the voltage correction coefficient, the accuracy of the voltage correction coefficient can be improved.

Moreover, although a plurality of ink droplets (n ink droplets) are made to be jetted from the nozzle 21 and the jetting speeds of the n ink droplets are measured when the jetting speeds of the ink droplets are measured by the liquid detection sensor 40 in the second embodiment, m (m>n) ink droplets may be jetted and n ink droplets among the m ink droplets may be measured.

Here, when the inventors of the present invention applied a drive signal of a predetermined voltage value to the actuator 22 to make a single nozzle 21 jet liquid many times and examined the fluctuation in the jetting speeds of the liquid, the histogram of the dispersion was a normal distribution in any nozzles 21 as the results. Thus, if the dispersion of the jetting speeds is the normal distribution, a value with high statistical reliability can be acquired even if the numbers of samples is 5 to 10 times. That is, when ink is jetted by a plurality of times ($n_1$ times, $n_2$ times or $n_3$ times), it is preferable that the number of jetting times be set within a range of from five times to ten times both inclusive in any case. Even if the jetting speed is not the mean jetting speed of the ink droplets jetted by a plurality of times, a jetting speed of a median may be adopted.

Furthermore, although the correction voltage value acquired at Step S13 is made to be reflected in the subsequent processes in the second embodiment, the correction voltage value may be acquired by adding the difference voltage value, which is the correction data, multiplied by the convergence coefficient to the drive voltage value at the time of the measurement of the jetting speeds of the ink liquid droplets, and the acquired correction voltage value may be reflected to the subsequent processes similarly to the first embodiment also in the second embodiment. Thereby, even when the correction voltage value calculated based on the mean jetting speed is likely to diverge to the target value, it becomes possible to converge the correction voltage values to the target value.

It is needless to say that the present invention is not limited to the first and the second embodiments described above, but can be suitably modified.

For example, although the case where the jetting speed of ink is detected with the CCD camera 42 is exemplified to be described in the present embodiments, any aspects capable of detecting the jetting speed of ink may be adopted. In addition to the CCD camera 42, for example, a method of detecting the jetting speed by jetting ink to pass an emitted light ray from an LED light source and acquiring the time during which the emitted light ray is intermitted can be cited.

Furthermore, the case where the liquid detection sensor 40 detects the jetting speed of ink is exemplified to be described in the present embodiments. But, even if the liquid detection sensor detects the jetting quantity of ink, the size (cross-section area) of an ink droplet, the diameter of the ink droplet, or the like, it is possible to acquire the same operation, and the same effects as those of the drive voltage correction described above. Here, in a case of detecting the jetting quantity of ink, for example, a method of performing the image processing of extracting the areas of the ink droplet parts from an image photographed with the CCD camera 42 to calculate the capacity of the ink droplets from the obtained areas can be used. Moreover, the areas of the ink droplet parts acquired by the CCD camera 42 may be treated as the sizes of the droplets. Moreover, as for the sizes of the droplets, a method of performing the image processing of extracting the edges of the ink droplet parts of the image photographed with the CCD camera 42 to calculate the diameters of the edges can be used.

As mentioned above, although the case where the liquid jetting device and the drive voltage correction method according to the present invention are applied to the ink jet printer 1 is exemplified to be described, the liquid jetting device and the drive voltage correction method of the present invention can be also adopted in a manufacturing apparatus or the like which is used for coating an EL material of an organic EL display, coating a color filter material of a liquid crystal display panel, and the like.

The entire disclosure of Japanese Patent Application No. Tokugan 2004-235451 which was filed on Aug. 12, 2004 including specification, claims, drawings and summary is incorporated herein by reference in its entirety.

What is claimed is:

1. A liquid jetting device, comprising:

a recording head including a jetting energy generating element to generate a liquid jetting energy for making a nozzle jet liquid;

a drive circuit to generate a drive signal for driving the jetting energy generating element;

a liquid detection sensor to detect a jetting characteristic value of the liquid jetted from the nozzle;

a drive voltage adjustment unit to adjust a voltage value of the drive signal of the drive circuit; and a control unit to control the drive circuit, the liquid detection sensor and the drive voltage adjustment unit, wherein the control unit controls the drive voltage adjustment unit and the drive circuit so that the liquid is jetted from the nozzle, and creates a correction data from the jetting characteristic value of the jetted liquid detected by the liquid detection sensor; and the control unit controls the drive voltage adjustment unit and the drive circuit so that the voltage value of the drive signal is corrected based on a value which is obtained by multiplying the correction data by a convergence coefficient within a range of from 0.50 or more to less than 1.00, and the control unit repeats correcting the voltage value until a detection result of the liquid which was jetted based on the drive signal after the correction by the liquid detection sensor becomes a target value.

2. The liquid jetting device of claim 1, wherein the convergence coefficient is 0.99 or less.

3. The liquid jetting device of claim 1, wherein the convergence coefficient is 0.70 or more.

4. The liquid jetting device of claim 1, wherein the convergence coefficient is 0.98 or less.

5. The liquid jetting device of claim 1, wherein the control unit controls the drive voltage adjustment unit and the drive circuit so that the liquid is jetted a plurality of times from the nozzle based on the same drive signal, and the control unit creates the correction data based on jetting characteristic values of the liquid jetted the plurality of times, the jetting characteristic values being detected by the liquid detection sensor.

6. The liquid jetting device of claim 5, wherein the control unit controls the drive circuit so that the number of jetting times at the time of creating the correction data is within a range of from 5 times to 10 times both inclusive.

7. The liquid jetting device of claim 5, wherein the control unit creates the correction data based on a mean value of the jetting characteristic values of the liquid jetted the plurality of times, the jetting characteristic values being detected by the liquid detection sensor.

8. The liquid jetting device of claim 1, wherein the recording head is provided with a plurality of nozzles;

the jetting energy generating element generates the liquid jetting energy to each of the plurality of nozzles; and the control unit controls the drive voltage adjustment unit and the drive circuit to make them generate an independent drive signal to each of the plurality of nozzles.

9. The liquid jetting device of claim 1, wherein the jetting characteristic value is any one of a jetting speed, a jetting quantity, a size of a droplet and a diameter of the droplet of the liquid jetted from the nozzle.

10. The liquid jetting device of claim 1, wherein the recording head is provided with a plurality of nozzles; and the drive circuit generates an independent drive signal to each of the plurality of nozzles.

11. A liquid jetting device, comprising:

a recording head including a jetting energy generating element to generate a liquid jetting energy for making a nozzle jet liquid;

a drive circuit to generate a drive signal for driving the jetting energy generating element;

a liquid detection sensor to detect a jetting characteristic value of the liquid jetted from the nozzle;

a drive voltage adjustment unit to adjust a voltage value of the drive signal of the drive circuit; and a control unit to control the drive circuit, the liquid detection sensor and the drive voltage adjustment unit, wherein the control unit controls the drive voltage adjustment unit and the drive circuit so that the liquid is jetted by the same drive signal from the nozzle a plurality of times, and creates a correction data based on jetting characteristic values of the liquid jetted the plurality of times by the liquid detection sensor; and the control unit controls the drive voltage adjustment unit and the drive circuit so that the voltage value of the drive signal is corrected based on the correction data, and repeats correcting the voltage value until a detection result of the liquid detection sensor of the liquid jetted based on the drive signal after the correction becomes a target value.

12. The liquid jetting device of claim 11, wherein the control unit controls the drive circuit so that the number of jetting times at the time of creating the correction data is within a range of from 5 times to 10 times both inclusive.

13. The liquid jetting device of claim 11, wherein the control unit creates the correction data based on a mean value of the jetting characteristic values of the liquid jetted the plurality of times, the jetting characteristic values being detected by the liquid detection sensor.

14. The liquid jetting device of claim 11, wherein the recording head is provided with a plurality of nozzles;

the jetting energy generating element generates the liquid jetting energy to each of the plurality of nozzles; and the control unit controls the drive voltage adjustment unit and the drive circuit to generate an independent drive signal to each of the plurality of nozzles.

15. The liquid jetting device of claim 11, wherein the jetting characteristic value is any one of a jetting speed, a jetting quantity, a size of a droplet and a diameter of the droplet of the liquid jetted from the nozzle.

16. A drive voltage correction method, comprising:

jetting liquid from a nozzle of a recording head by applying a drive signal for driving a jetting energy generating element to the jetting energy generating element generating liquid jetting energy for making the nozzle jet the liquid, by a drive circuit generating the drive signal and by a drive voltage adjustment unit adjusting a voltage value of the drive signal of the drive circuit;

creating a correction data based on a jetting characteristic value of the liquid jetted with a liquid detection sensor;

correcting the voltage value of the drive signal based on a value which is obtained by multiplying the correction data by a convergence coefficient within a range of from 0.50 or more to less than 1.00; and repeating the correcting the voltage value until a detection result of the liquid detection sensor of the liquid jetted based on the drive signal after the correcting becomes a target value.

17. A drive voltage correction method, comprising:

jetting liquid from a nozzle of a recording head a plurality of times by applying a same drive signal for driving a jetting energy generating element a plurality of times to the jetting energy generating element generating liquid jetting energy for making the nozzle jet the liquid, by a drive circuit generating the drive signal and by a drive voltage adjustment unit adjusting a voltage value of the drive signal of the drive circuit;

creating a correction data based on jetting characteristic values of the liquid jetted the plurality of times with a liquid detection sensor;

correcting the voltage value of the drive signal based on the correction data; and repeating the correcting the voltage value until a detection result of the liquid detection sensor of the liquid jetted based on the drive signal after the correcting becomes a target value.

18. The drive voltage correction method of claim 17, wherein the number of the jetting times at the time of creating the correction data is within a range of from 5 times to 10 times both inclusive.

19. The drive voltage correction method of claim 17, wherein the correction data is created based on a mean value of the jetting characteristic values of the liquid jetted the plurality of times, the jetting characteristic values being detected by the liquid detection sensor.

20. The drive voltage correction method of claim 17, wherein the recording head is provided with a plurality of nozzles;

the jetting energy generating element generates the liquid jetting energy to each of the plurality of nozzles; and an independent drive signal is generated to each of the plurality of nozzles by the drive voltage adjustment unit and the drive circuit.

21. The drive voltage correction method of claim 17, wherein the jetting characteristic value is any one of a jetting speed, a jetting quantity, a size of a droplet and a diameter of the droplet of the liquid jetted from the nozzle.

* * * * *